US005572806A

United States Patent [19]

Osawa

[11] Patent Number: 5,572,806

[45] Date of Patent: Nov. 12, 1996

[54] FLEXIBLE SKI BOOTS HAVING A PIVOTAL TOE PORTION

[76] Inventor: Kazuo Osawa, No. 3-4, 3-Chome, Tokyo 181, Japan

[21] Appl. No.: 370,622

[22] Filed: Jan. 10, 1995

[30] Foreign Application Priority Data

Dec. 3, 1994 [JP] Japan ..... 6-332794

[51] Int. Cl.[6] ..... A43B 5/04; A43B 13/14; A43B 13/00

[52] U.S. Cl. ..... 36/117.4; 36/31; 36/103

[58] Field of Search ..... 36/117, 118, 119, 36/120, 121, 103, 31

[56] References Cited

U.S. PATENT DOCUMENTS

| | | | |
|---|---|---|---|
| 3,740,873 | 6/1973 | Sturany | 36/117 |
| 4,043,059 | 8/1977 | Rathmell | 36/121 |
| 4,261,114 | 4/1981 | Vilettd | 36/120 |
| 4,677,769 | 7/1987 | Ahmad et al. | 36/117 |
| 4,839,972 | 6/1989 | Pack et al. | 36/117 |

FOREIGN PATENT DOCUMENTS

| | | | |
|---|---|---|---|
| 197802 | 3/1978 | France | 36/117 |
| 48-98339 | 11/1973 | Japan . | |

*Primary Examiner*—B. Dayoan

[57] ABSTRACT

A flexible ski boot includes a divided rigid sole and a flexible hard boot body, the sole being divided into a rigid thick toe portion and a rigid thick heel portion. The boot body is composed of a hard toe portion, a soft flexible connecting portion and a hard heel portion which is, respectively, united or joined with the divided rigid sole. The divided rigid sole is connected, respectively, through a hinge between the toe portion and the heel portion so that the rigid ski boot can be bent at the soft elastic portion of the boot body for easier walking. The toe portion of the sole includes inwardly an elastic locking mechanism to lock elastically the hinge between the heel portion and permits the sole to be maintained evenly and to hold a suitable slouch during a descent, when the flexible ski boot is set into a binding, for safe skiing. The rear end of the sole is cut out diagonally as an additional aid for easier walking. The inside of the flexible ski boot is coated with a soft plastic layer for water-proof, dust-proof, etc.

21 Claims, 4 Drawing Sheets

FLEXIBLE SKI BOOTS HAVING A PIVOTAL TOE PORTION

FIELD OF THE INVENTION

This invention relates to flexible rigid ski boots whereby the wearer is able to walk easily on a street, a lobby of a hotel or a lodge.

BACKGROUND OF THE PRESENT INVENTION

Generally, a ski boot has a thick sole of rigid plastic material combined with a hard boot body to hold a suitable slouch during a descent, and to maintain sole in parallel with a ski as soon as the toe portion is fixed into a binding on the ski or ski board.

Therefore, the ski boot is unsuitable for walking which requires bending the toe portion, and for climbing a slope with the ski.

In view of the above inconvenience of the known ski boot, the present inventor has suggested a flexible ski boot in Japanese Patent No. 1,662,495 (Kokai No. HEI-3-24,201) wherein the sole of the boot comprises a rigid toe portion provided with a locking means inwardly and a main heel portion provided with a receiving hole for the locking means, respectively, wherein both portions are connected flexibly by a hinge means arranged on the bottom surface and a soft elastic material between both portions, for walking, and which are locked releasably by the locking means to hold the sole parallel to the ski binding when the ski is in use. The connected portion, however, permits an invasion of water, snow, dust, etc., into the boot through a V-shaped groove formed naturally between the toe portion and main heel portion, even if the groove is filled with soft elastic material. There is also a danger of injury to the sole of the foot due to getting in both ends of the V-shaped groove, during walking.

SUMMARY OF THE PRESENT INVENTION

According to one embodiment, the flexible ski boot comprises a rigid thick sole connected with a rigid toe portion and a rigid main heel portion by a soft elastic material. A hard boot body is united or joined to hard toe portion and a hard main heel portion through an elastic soft portion, the rigid thick sole portion being joined to the hard boot body in the conventional manner so that the ski boot can be bent for walking due to the elasticity of the boot sole and boot body. The soft elastic material joining the hard boot body and the hard toe portion may be laminated layer. A locking means in the toe portion of the sole fixes together firmly the toe portion and the main heel portion so that the sole can be held evenly without bending as a conventional ski boot.

The rigid thick sole of one embodiment is also provided inwardly with a hinge means between the toe portion and the main heel portion to connect and turn up and down both portions. The main heel portion can turn up and down about an axis of the hinge for walking, and permits the ski boot to flex more easily during walking than the conventional ski boot due to the collapse of the elastic soft portion of the boot body.

A locking means comprises a combination of an elastic locking member in a pass-through hole of the toe portion and a receiving hole on the main heel portion. If a head of the elastic locking means which slightly projects from the toe portion, is pushed by a claw portion of the binding as soon as the ski boot is put into the binding, the locking piece goes into the receiving hole on a support of the hinge means to link elastically the main heel portion with the toe portion until release of the ski boot from the binding.

The boot body is also wholly coated inwardly with a water-proof material to prevent the invasion of moisture, dust, snow, etc., from the hinge connection of the rigid thick sole. The rigid thick sole is slightly bent upwardly and downwardly to absorb the vibration, pressure, strain, etc., on the ski boot induced from the ski or board, by means of the hinge means and the elastic soft portion, during skiing on an uneven slope, and the rear end may be cut diagonally to make more easier walking.

It is an object of the present invention to provide a flexible ski boot in which the wearer can walk easily in spite of its rigid thick sole material.

It is another object of the present invention to provide a locking means for a ski boot in which the wearer can walk easily in spite of a rigid thick sole material when the locking means releases the ski boot from a binding, and which can firmly lock the toe portion with the main heel portion so as to hold the sole parallel as in a conventional ski boot as soon as the ski boot is put into the binding when the ski or board is in use.

It is another object of the present invention to provide a hinge means for a ski boot which makes a turn up and down movement of the main heel portion about an axis of the hinge means to collapse an elastic soft portion of the boot body for walking.

It is a further object of the present invention to provide a flexible ski boot which is able to respond sensitively to a variation of a ski or board during skiing.

It is a further object of the present invention to provide a flexible ski boot for more easier walking by cutting diagonally a rear end of the rigid thick sole.

It is still another object of the present invention to provide a flexible ski boot which is water-proof and dust-proof due to an inside dense plastic or rubber layer of the boot body joined with the rigid thick sole in a conventional manner.

DETAILED DESCRIPTION OF THE PREFERRED EMBODIMENTS

Figure 1:
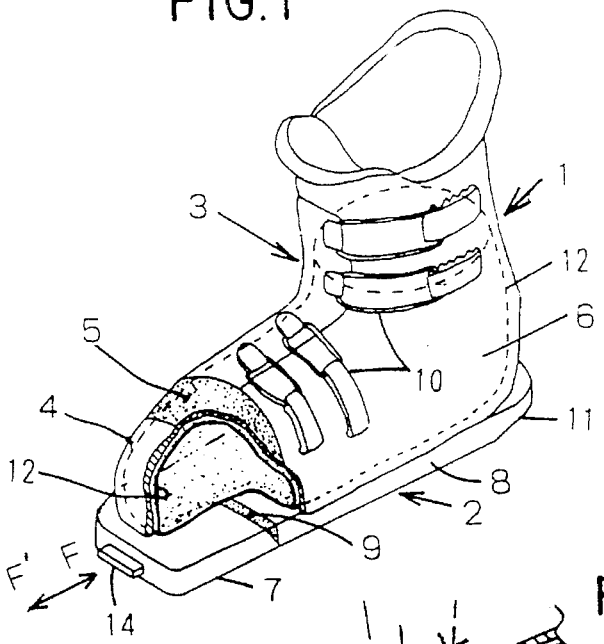
FIG. 1 is a partial sectional perspective view of a flexible ski boot according to one embodiment of the present invention.
Figure 2:
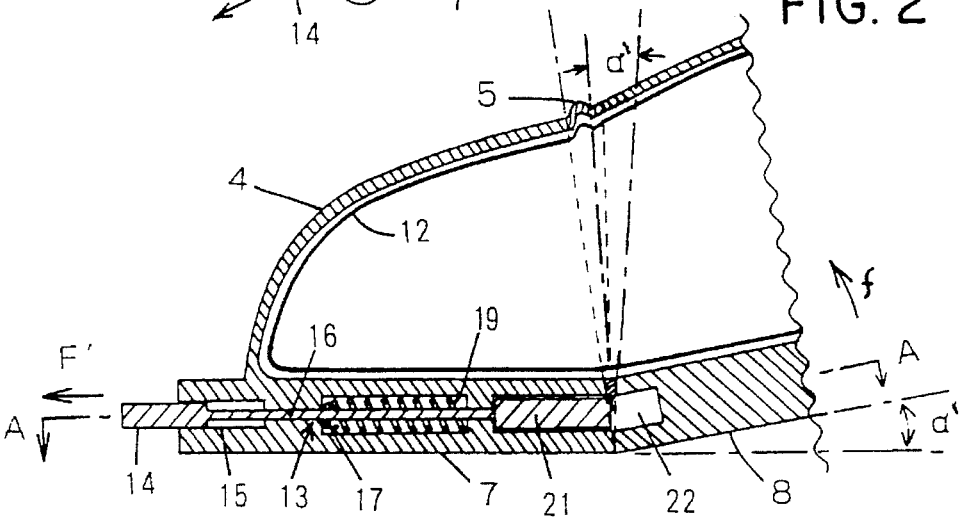
FIG. 2 is a partial sectional view of one side of the flexible ski boot shown in FIG. 1.
Figure 3:
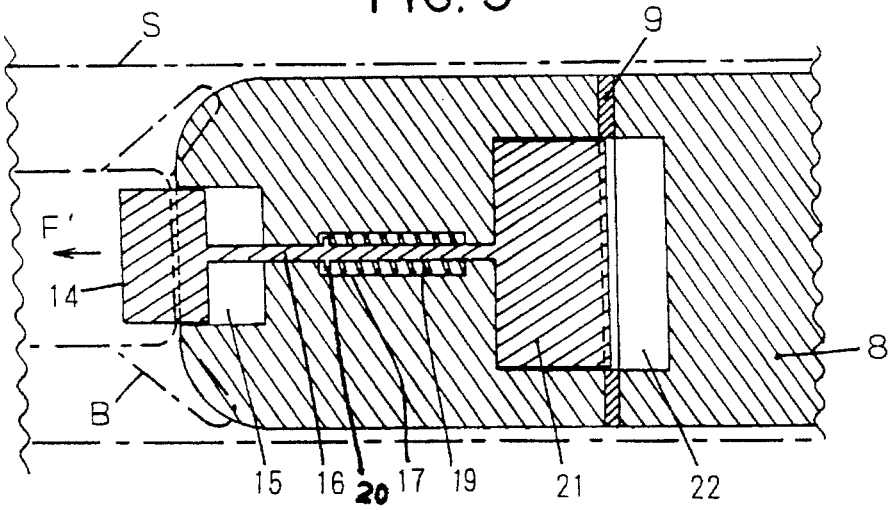
FIG. 3 is a partial sectional plan view of the flexible ski boot shown in FIG. 2 through a line A—A of FIG. 2.

Referring to the drawings and particularly FIG. 1 to 3, a flexible ski boot 1 is illustrated as a partial sectional perspective view. The boot 1 comprises principally a divided rigid thick sole 2 and a flexible hard body 3 united or joined firmly with the sole in a conventional manner. The divided rigid thick sole 2 comprises a rigid toe sole portion 7 and a rigid main heel sole portion 8 connected through a V-shaped soft elastic material 9 united or joined with a soft elastic portion 5 of the flexible hard boot body 3. The flexible hard boot body 3 comprises also a hard toe body portion 4, the soft elastic portion 5 and a hard main heel body portion 6, and is covered inwardly with a water-proof layer 12 to prevent invasion of moisture, dust, etc., through the V-shaped soft elastic material 9 connected with the rigid toe sole portion 7 and the rigid main heel sole portion 8 of the rigid thick sole 2.

The rigid toe sole portion 7 is provided with a locking means 13 inwardly, which can slide elastically into a hole 22 of the rigid main heel sole portion 8 by inner pass-through holes 15 and 17 to maintain evenly the rigid thick sole 2 during skiing. The locking means 13 is provided with a locking piece 21 and an actuating head 14 connected by a link 16. When the ski boot is set into a binding B of the ski or board S the actuating head 14 is pushed into the inner hole 15, and slides elastically into the holes toward an arrow F by means of coil spring 19. A projection 20 in the link 16 locks the rigid toe sole portion 7 with the rigid main heel sole portion 8 through a hole (not shown) of the soft material 9 and the hole 22 of the later portion. Accordingly, the rigid thick sole 2 is linked with the locking means 13 and is held evenly without any bending in the binding B, and holds a suitable slouch for a wearer during descent.

The soft elastic portion 5 of the hard flexible boot body 3 and the V-shaped soft elastic material 9 of the rigid thick sole 2 are not only united or joined together but also both of their side portions. This allows the rigid main heel sole portion 8 to bend up $\alpha'$ degrees toward an arrow f as shown in FIG. 2 due to the collapse of $\alpha'$ degrees of the soft elastic portion 5. Consequently the flexible ski boot 1 permits easier walking than the conventional ski boot on a street or a lobby of a hotel, when the locking means 13 is released from the binding B.

The hard main heel body portion 6 of the flexible ski boot 1 may be a high cut type and may be provided with a strong bootlace or multiple boot belts 10 to firmly tie up about the ankle portion for prevention of sprain or fracture of a bone.

The rigid main heel sole portion 8 of the rigid thick sole 2 may also be cut diagonally at its rear end for more easier walking, and the cut surfaces 11, cut again unevenly, prevents slipping during walking.

Figure 4:
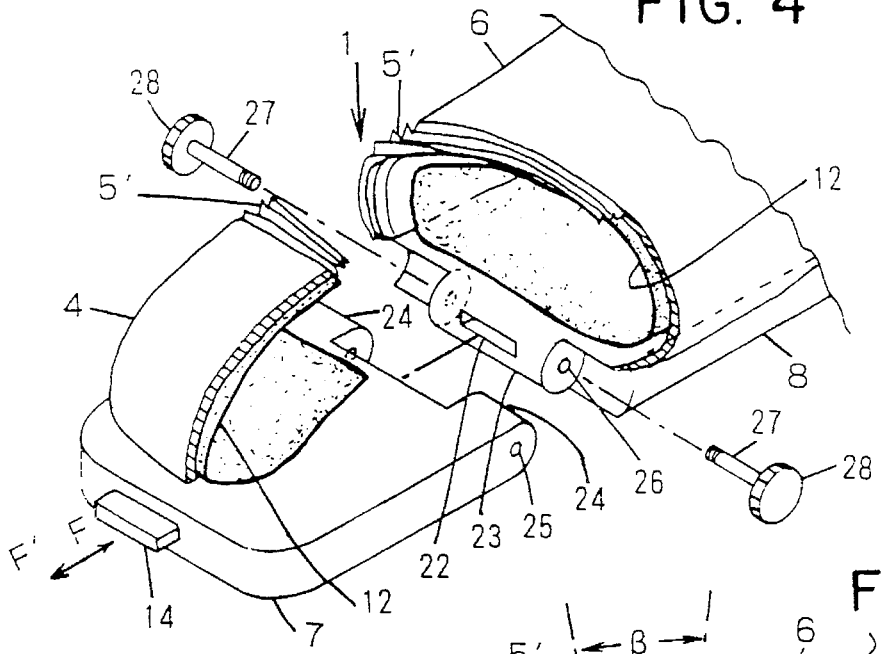
FIG. 4 is a partial sectional perspective view of another embodiment of the ski boot of the present invention showing a hinge means between a toe portion and a main heel portion of the rigid thick sole.
Figure 5:
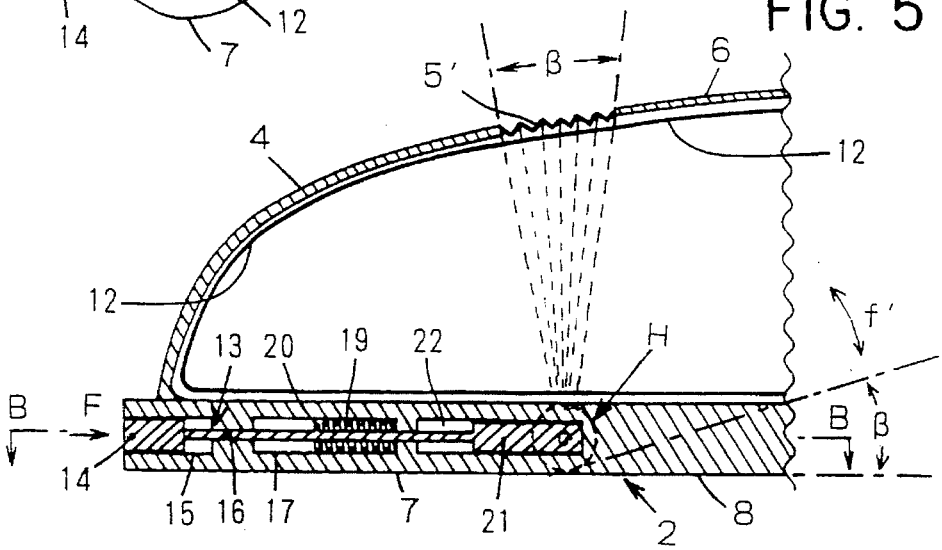
FIG. 5 is a partial sectional view of one side of FIG. 4.
Figure 6:
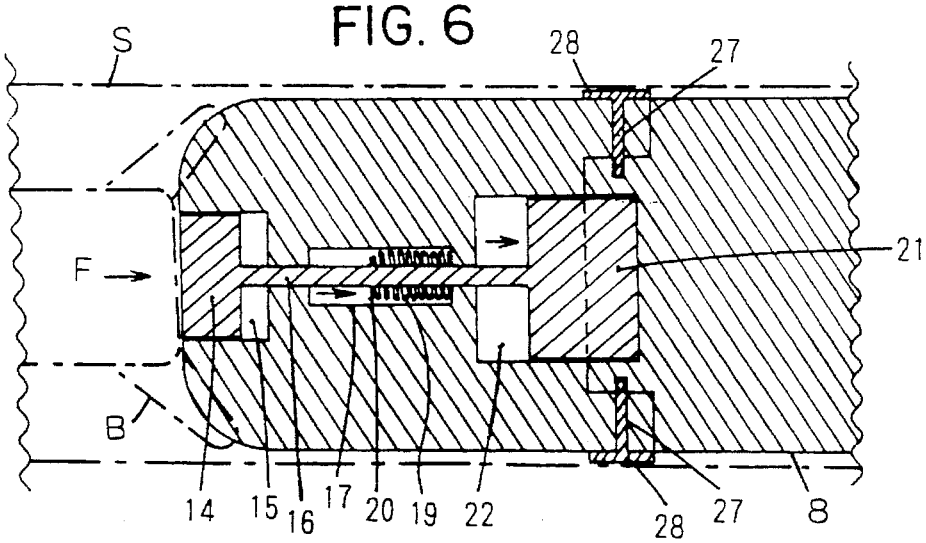
FIG. 6 is a partial sectional plan view through a line B—B of FIG. 5.

Referring to FIG. 4 to FIG. 6, another embodiment of the flexible ski boot 1 is illustrated as a partial sectional perspective view, a partial sectional view and a partial view through a line B—B of FIG. 5. In this embodiment the boot 1 comprises a divided rigid thick sole 2 and a flexible hard boot body 3 united or joined firmly with the former in the usual manner. The divided rigid thick sole 2 also comprises a rigid toe portion 7 and a rigid main heel portion 8 and both portions are connected by a hinge means H as described hereafter. The rigid toe sole portion 7 is provided inwardly with a locking means 13 as in the embodiment of FIG. 1. A pair of hinge ear pieces 24 at one end of the toe sole portion 7 provides a pivotal connection with the rigid main heel sole portion 8.

The rigid main heel sole portion 8 is also provided with a hinge support 23 having a hole 22 for the locking piece 21 of the locking means 13. The rigid main sole portion 8 is connected pivotally with the rigid toe sole portion 7 by means of the hinge ear pieces 24, the hinge support 23 and a pair of pivots 28, through holes 25 of the ear pieces and hole 26 of the hinge support 23.

The hard flexible boot body 3 is almost the same as the embodiment in FIG. 1 but a soft bellows portion 5', which may be a laminate, is used for the soft elastic portion 5 united or joined with the V-shaped soft elastic material 9 of the rigid thick sole 2.

In this embodiment, the rigid main heel sole portion 8 can be turned up pivotally, within $\beta$ degrees in the direction of arrow f' about axles 27 of the pair of pivots 28 due to a collapse of the soft bellows portion 5' within $\beta$ degrees. The collapse of portion 5' with the hinge H of the rigid thick sole 2 allows the rigid ski boot to walk easier on the street as mentioned before with the embodiment of FIG. 1.

The locking means 13 in the rigid toe sole portion 7 may also have the same mechanism as in FIG. 1. However, the locking piece 21 does not slide directly into a hole 22 of the rigid main heel sole portion 8 through the soft material 9 but into a hole 22 of the hinge support 23, as soon as the actuating head 14 is pushed into the hole 15 in the direction of arrow F by, for example, the inside surface of the binding B as shown in FIG. 4 to FIG. 6, and thereby locking firmly the divided rigid thick sole 2 to be held evenly for skiing, as mentioned before.

Figure 7:
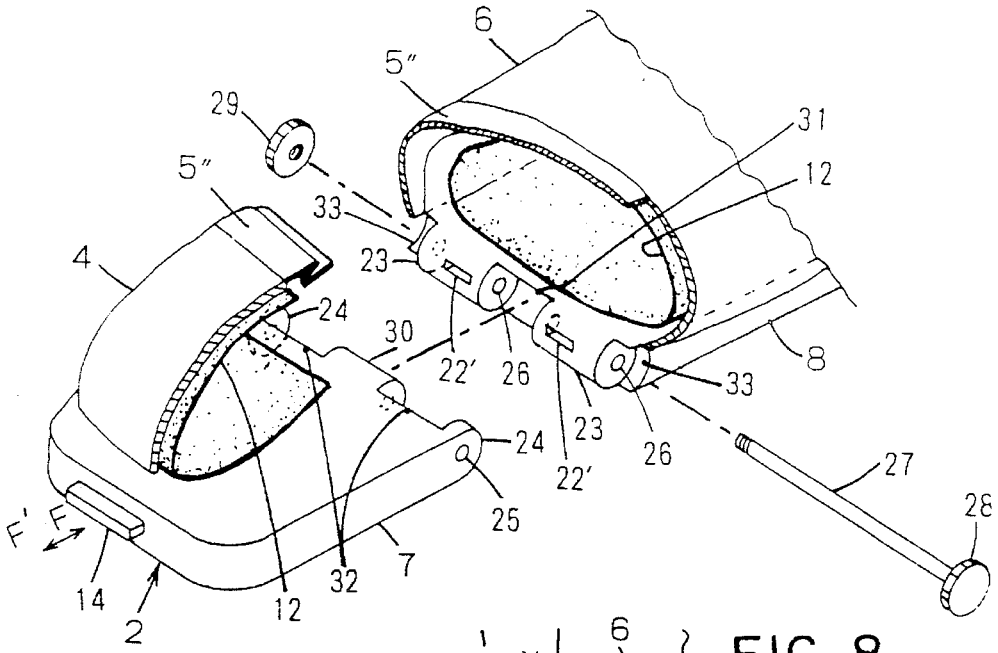
FIG. 7 is a partial sectional perspective view of a further embodiment of the ski boot of the present invention showing a hinge means between a toe portion and a main heel portion of the rigid thick sole.
Figure 8:
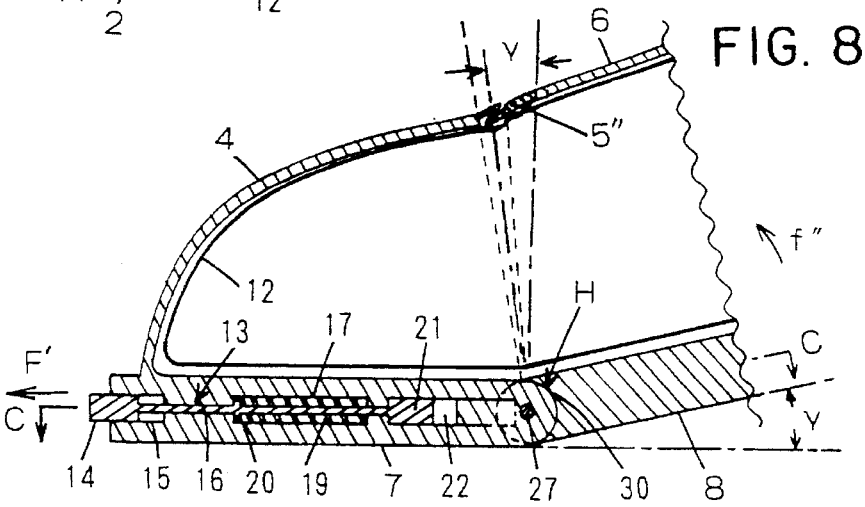
FIG. 8 is a partial sectional view of one side of FIG. 7.
Figure 9:
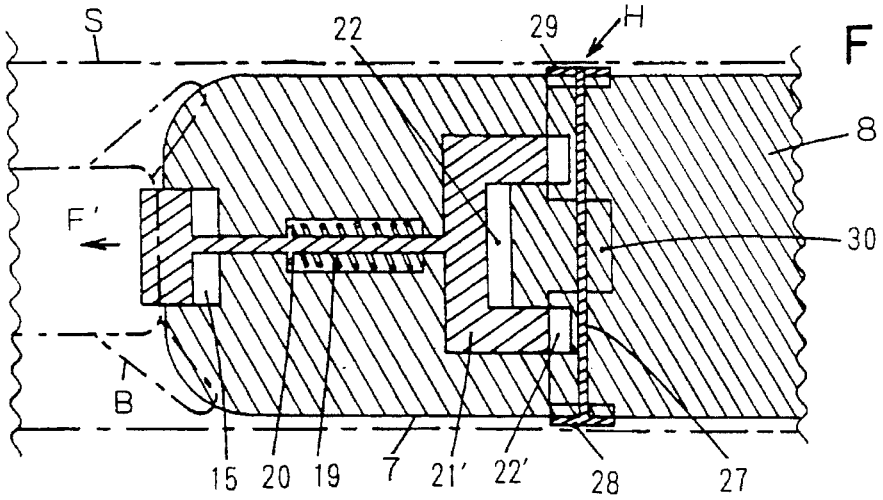
FIG. 9 is a partial sectional plan view through a line C—C of FIG. 8.

FIG. 7 to FIG. 9 show a further embodiment of the flexible ski boot 1. The flexible ski boot 1 is almost the same as the boot in FIG. 1 or FIG. 4 except for a soft elastic blind portion 5" in the hard elastic boot body 3 and a forked hinge means H' in the rigid thick sole 2. Therefore, the description hereunder shall be principally made to those different means and characteristics only, and the same parts of the embodiments will be illustrated with the same reference characters.

The divided rigid thick sole 2 comprises a rigid toe sole portion 7 provided with an inward locking means 13 and a rigid main heel sole portion 8, and both portions are connected with a forked hinge means H'. The hinge means H' comprises a pair of hinge ear pieces 24, a hinge support 30 arranged at a rear end of the rigid toe sole portion 7, a pair of hinge supports 23 arranged at a front end of the rigid main heel sole portion 8, two holes 22 and 22' for a pair of forked locking pieces 21 and 21' of the locking means 13, and a pivot 28. In the connection of the hinge means H', the hinge ear pieces 24 and the hinge support 30 at the rear end of the rigid toe sole portion 7, are put into the confronting cavities 31 and 33 at the front end of the rigid main heel sole portion 8, and hinge support 23 of the rigid main heel sole portion, into the confronting cavities 32 on the opposite side, respectively. The pivot 28 is inserted into the holes 25 and 26 which are aligned in a row and is tightened with a nut 29 to pivotally connect the rigid toe sole portion 7 and the rigid main heel sole portion 8.

The hard flexible boot body 3 illustrated in FIG. 7 is almost the same as in FIG. 1 or FIG. 4, except for the soft elastic blind portion 5" which is united or joined firmly with the divided rigid thick sole 2 in the usual manner, as mentioned before.

The flexible ski boot 1 illustrated partially in FIG. 8 shows a front portion in which a wearer is able to walk on the street after release from a ski or board. In this situation, the rigid main heel portion 8 of the divided rigid thick sole 2 can bent up within γ degrees in the direction of arrow f" about an axle 27 of the pivot 28, due to the collapse of the soft elastic blind portion 5" within γ degrees and permits the wearer of the flexible ski boot 1 to easily walk.

The rigid toe sole portion 7 and the rigid main heel sole portion 8 of the divided rigid thick sole 2 is locked evenly by a forked locking means 13 for attachment to the ski during use. The forked locking pieces 21" elastically slide into the holes 22' of the hinge supports 23 when the actuating head 14 is pushed into the hole 15 in the direction shown by the arrow F. In other words, when the flexible ski boot 1 is set into the binding B, the hinge connection H' locks to maintain evenly the divided rigid thick sole 2 during skiing.

The locking means 13 is also elastically released in the direction of arrow F' when the flexible ski boot 1 is removed from the ski or board S and the ski boot 1 is restored to an easier walking condition.

The material for the rigid and hard portion of the boot is selected from a hard plastic group such as super high molecular polyethylene, HPE (hard polyethylene), PP (polyproylene), PU (polyurethane), etc., and the soft elastic portions 5, 5' and 5" may be made from a soft rubber, leather, soft plastics, etc., in the form of the soft elastic layer, soft bellows layer, soft blind layer, respectively. The locking means 13 may also be manufactured from a hard aluminum, stainless steel, etc., which is solid and anti-corrosive.

Figure 10:
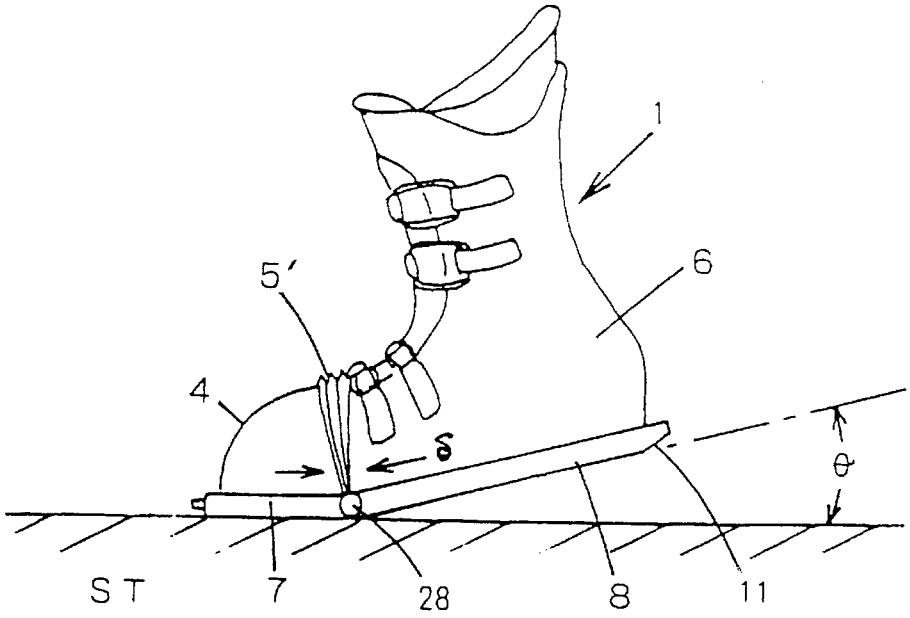
FIG. 10 is a side view of the flexible ski boot showing the function of the elastic soft portion and the hinge means.
Figure 11:
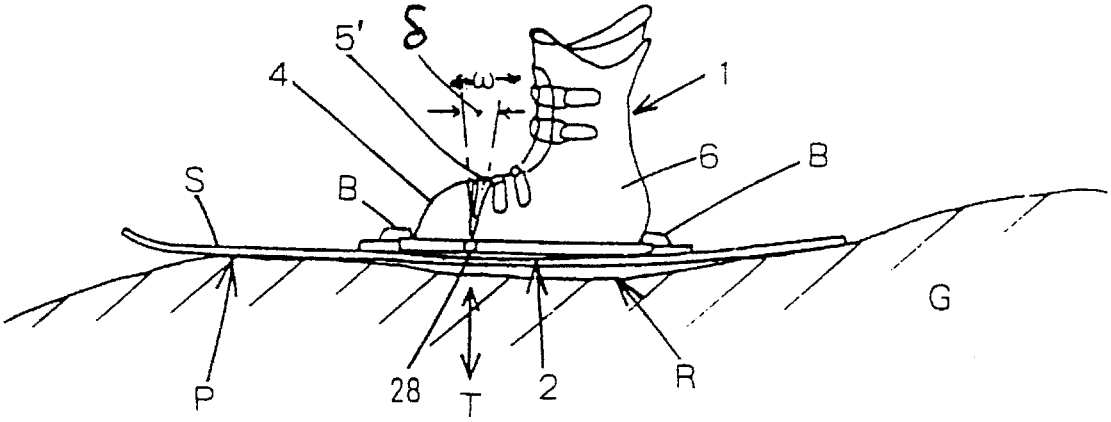
FIG. 11 is a functional view of the flexible ski boot on an uneven slope during skiing.

While walking, as mentioned before, the flexible ski boot 1 can bend its rigid sole at a point of the hinge means 28 or by the soft elastic material 5 and 9 or 5' and H or 5" and H" within θ degrees due to the collapse of the soft bellows portion 5' or the soft elastic portion 5 or the blind portion 5" as shown by δ and θ in FIG. 10 and FIG. 11. The toe sole portion 7 accordingly can kick the street surface ST back to force forwardly the wearer, and permits the wearer to easier walk.

When skiing, the flexible ski boot 1 is ordinarily maintained evenly on the ski or board S on fiat ground, due to the rigid thick sole 2 locked with the locking means 13. The boot 1, however, receives reciprocating stress upwardly and downwardly in the direction of the arrow T, which may induce a crack in the hard boot body if it is a conventional boot during sliding on an uneven slope G, as shown in FIG. 11. In such a case, the reciprocating stress is induced by a continuous bending movement upwardly and downwardly, because the ski or board is disposed on uneven surfaces R and P or the slope. However, the stress on the flexible ski boot embodiments of the present invention is absorbed due to the collapse, for example, of the elastic soft bellows portion 5' in the direction of the arrows ω and δ, together with a flexible mechanism of the hard portion of the boot body. Therefore the flexible ski boot is prevented from cracking.

While there has been described and pointed out the fundamental features of the invention as applied to the preferred embodiments, it will be understood that various omissions and substitutions and changes in the form and details of the flexible ski boot illustrated and many modifications may be made by those skilled in the art, without departing from the spirit of the invention.

I claim:

1. A flexible alpine ski boot comprising:

a divided rigid thick sole and a hard flexible boot body, the divided rigid thick sole comprising a toe sole portion and a heel sole portion which is connected flexibly with a flexible connecting means therebetween;

the heel sole portion having disposed inwardly therein a receiving hole;

the toe sole portion having disposed inwardly therein a locking means for releasably connecting the toe sole portion with the receiving hole in the heel sole portion to provide a substantially rigid and continuous sole against stress added on the divided rigid thick sole during operation of the locking means;

the locking means having a spring means for urging a locking piece into the receiving hole;

the hard flexible boot body comprising a hard toe body portion, a soft elastic portion and a hard heel body portion joined with the divided rigid thick sole; and the ski boot being inwardly covered with a soft material to prevent invasion of foreign substances.

2. The ski boot according to claim 1 wherein the toe sole portion of the rigid thick sole is connected with the heel sole portion through a V-shaped soft material jointed with the soft elastic portion of the hard flexible boot body; and the toe sole portion is permitted to rise up and down with respect to the heel sole portion due to the flexibility of the V-shaped soft material joined with the soft flexible connecting portion of the boot body.

3. The ski boot of according to claim 1 wherein the toe sole portion of the rigid thick sole is inwardly provided with means for connecting pivotally with a hinge support of the heel sole portion whereby the heel sole portion can rise up and down with respect to the toe sole portion about a pivot of the connecting means due to the flexibility of the soft flexible connecting portion of the boot body.

4. The ski boot according to claim 1 wherein a hinge ear piece of the toe sole portion and a hinge support of the heel sole portion is, respectively, at least one set and is pivotally connected with a pivot.

5. The ski boot according to claim 2 wherein a hinge ear piece of the toe sole portion and the hinge support of the heel sole portion is, respectively, at least one set and is pivotally connected with a pivot.

6. The ski boot according to claim 1 wherein the locking piece is a forked member.

7. The ski boot according to claim 2 wherein the locking piece is a forked member.

8. The ski boot according to claim 3 wherein the locking piece is a forked member.

9. The ski boot according to claim 1 wherein the material of the soft elastic portion comprises a soft rubber, a soft plastic or a soft leather.

10. The ski boot according to claim 2 wherein the material of the soft elastic portion comprises a soft rubber, a soft plastic or a soft leather.

11. The ski boot according to claim 3 wherein the material of the soft elastic portion comprises a soft rubber, a soft plastic or a soft leather.

12. The ski boot according to claim 1 wherein the soft elastic portion connecting the rigid toe body portion and the rigid heel body portion is a laminated layer which can slidably expand and contract.

13. The ski boot according to claim 2 wherein the soft elastic portion connecting the rigid toe body portion and the rigid heel body portion is a laminated layer which can slidably expand and contract.

14. The ski boot according to claim 3 wherein the soft elastic portion connecting the rigid toe body portion and the rigid heel body portion is a laminated layer which can slidably expand and contract.

15. The ski boot according to claim 1 wherein the soft elastic portion connecting the rigid toe body portion and the rigid heel body portion is in a form of a bellows which can be expanded and contracted.

16. The ski boot according to claim 3 wherein the soft elastic portion connecting the rigid toe body portion and the rigid heel body portion is a in a form of a bellows which can be expanded and contracted.

17. The ski boot according to claim 1 wherein an end of the rigid heel portion is cut off diagonally to permit easier walking and the cut surface is further cut into unevenly for the prevention of slipping by the wearer.

18. The ski boot according to claim 11 wherein an end of the rigid heel portion is cut off diagonally to permit easier walking and the cut surface is further cut into unevenly for the prevention of slipping by the wearer.

19. The ski boot according to claim 3 wherein an end of the rigid heel portion is cut off diagonally to permit easier walking and the cut surface is further cut into unevenly for the prevention of slippage by the wearer.

20. The ski boot according to claim 1 wherein the soft elastic portion connecting the rigid toe body portion and the rigid heel portion is in the form of a blind portion which can be expanded or contracted.

21. The ski boot according to claim 3 wherein the soft elastic portion connecting the rigid toe body portion and the rigid heel portion is in the form of a blind portion which can be expanded or contracted.

* * * * *